US005485914A

United States Patent [19]

Martin

[11] Patent Number: 5,485,914

[45] Date of Patent: Jan. 23, 1996

[54] COMPOSITE ARTICLE CARRIER

[75] Inventor: Roger L. Martin, San Jose, Calif.

[73] Assignee: Jefferson Smurfit Corporation, Clayton, Mo.

[21] Appl. No.: 336,010

[22] Filed: Nov. 8, 1994

[51] Int. Cl.[6] ..... B65D 75/28

[52] U.S. Cl. ..... 206/145; 206/158

[58] Field of Search ..... 206/141, 145, 206/147, 148, 149, 151, 158, 434; 294/87.2

[56] References Cited

U.S. PATENT DOCUMENTS 2,950,041 8/1960 Stone ..... 206/147

3,528,697 9/1970 Wood ..... 206/158 X 4,378,879 4/1983 Killy ..... 206/158

5,328,024 7/1994 Sutherland ..... 206/158

*Primary Examiner*—Jacob K. Ackun

*Attorney, Agent, or Firm*—Richard W. Carpenter

[57] ABSTRACT

A composite article carrier for articles such as bottles, or cans with bodies having tapered upper portions. The carrier includes an outer member, with article receiving openings of one size, and an inner member with smaller article receiving openings and adjacent retaining tabs that project through the openings of the outer member for engagement with the under sides of article end closures, to secure the articles to the carrier.

20 Claims, 2 Drawing Sheets

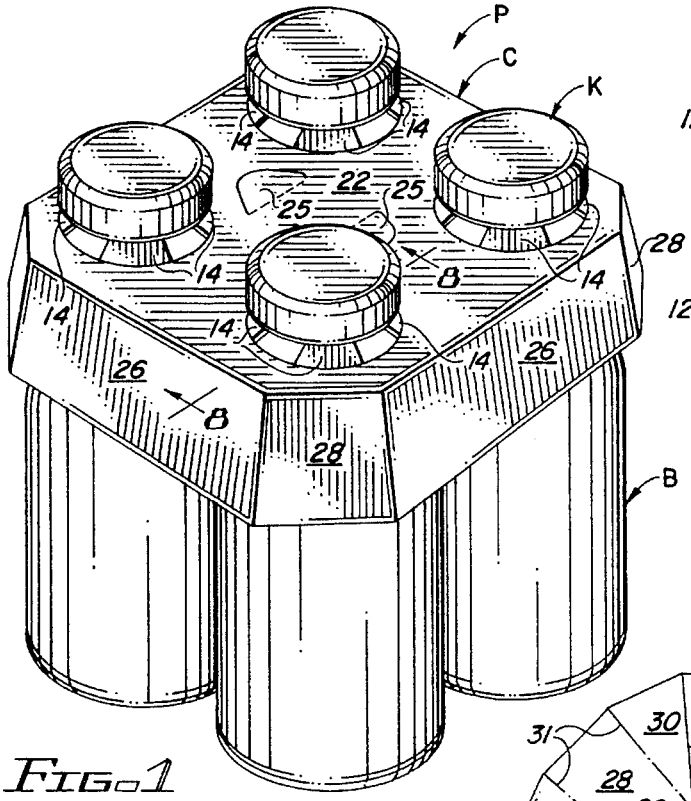
FIG. 1
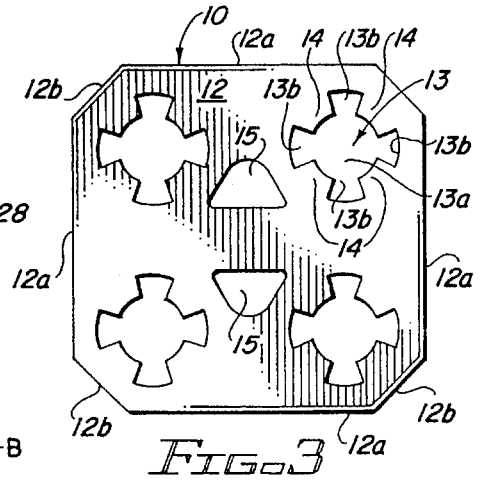
FIG. 3
FIG. 2
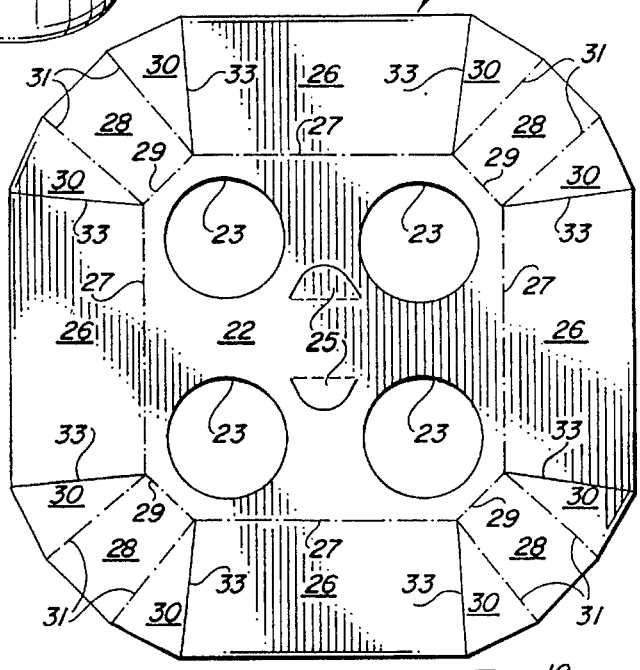
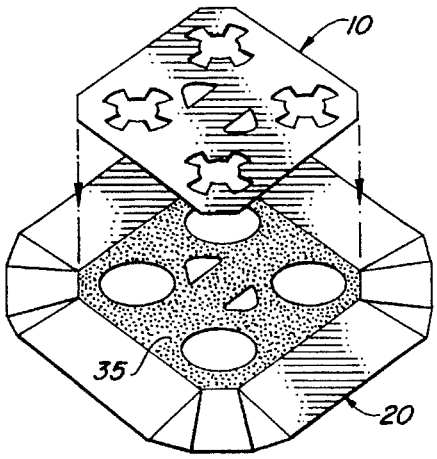
FIG. 4
FIG. 5
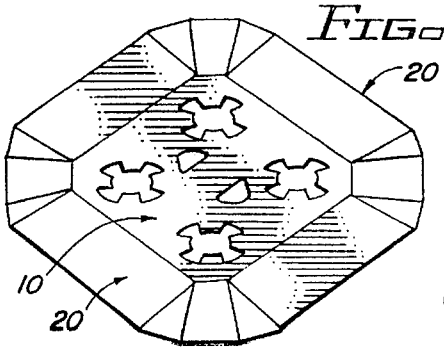
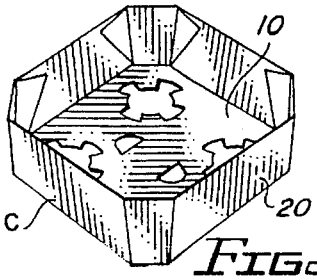
FIG. 6
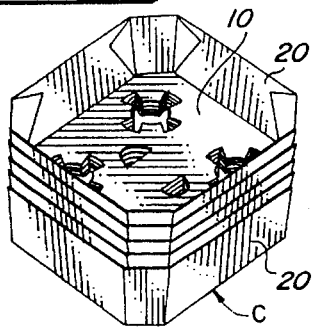
FIG. 7

COMPOSITE ARTICLE CARRIER

BACKGROUND OF THE INVENTION

1. Field of the Invention

This invention relates to packages for carrying groups of articles, such as beverage bottles or cans, and more particularly to a two piece carrier formed at least partly of paperboard.

2. Description of the Background Art

A background art search directed to the subject matter of this invention conducted in the United States Patent and Trademark Office disclosed the following U.S. Pat. Nos: 2,828,060; 3,097,785; 3,177,610; 3,507,440; 3,572,576; 4,915,292; 5,085,323; plus Japanese 404,279,447 and BE 657,238

None of the patents uncovered in the search discloses a composite article carrier, for articles such as bottles or cans with bodies having tapered upper portions, which carrier includes an outer member, with article receiving openings of one size, and an inner member, with smaller article receiving openings and adjacent retaining tabs that project through the openings of the outer member for engagement with the under sides of article end closures, to retain the articles in the carrier.

SUMMARY OF THE INVENTION

It is a primary object of the invention to provide a composite article carrier made of paperboard and/or plastic for holding a group of articles having tapered upper portions and end closures.

Another object of the invention is the provision of a carrier of the type described that can be made of less expensive material than conventional carriers and still provide sufficient strength to hold a group of articles for safe shipping and handling.

A more specific object of the invention is to provide a composite article carrier, for holding articles such as bottles or cans with bodies having tapered upper portions, which carriers include an outer member, with article receiving openings of one size, and an inner member with smaller article receiving openings and adjacent retaining tabs that project through the openings of the outer member for engagement with the under sides of article end closures, to retain the articles in the carrier.

These and other objects of the invention will be apparent from an examination of the following description and drawings.

BRIEF DESCRIPTION OF THE DRAWINGS

FIG. 1 is an isometric view of a package comprising a group of capped bottles held in a composite carrier embodying features of the present invention;

FIG. 2 is a plan view of the outer member of the carrier illustrated in FIG. 1, as shown in a flat condition;

FIG. 3 is a plan view of the inner member of the carrier illustrated in FIG. 1;

FIG. 4 is an exploded isometric view of the carrier, as shown before the outer and inner members are secured to each other;

FIG. 5 is a view similar to that of FIG. 4, but showing the inner and outer members secured to each other, but not erected;

FIG. 6 is an isometric view of a completely erected carrier, as seen from the underside; and FIG. 7 is an isometric view of a plurality of carriers, like the carrier illustrated in FIG. 6, shown nested with each other.

Figure 8:
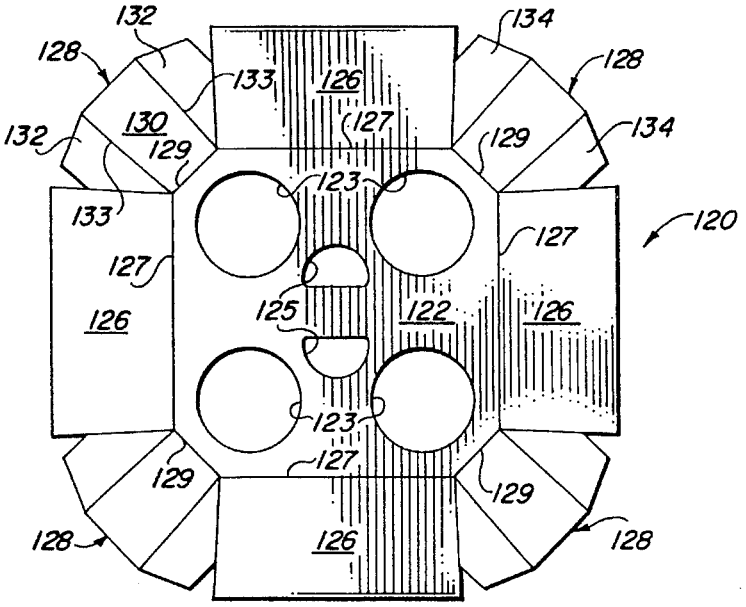
Figure 9:
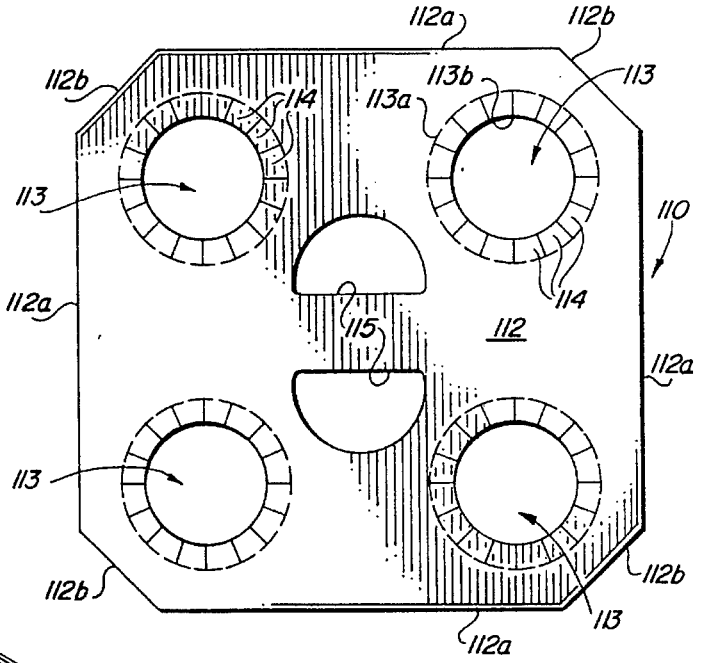
Figure 10:
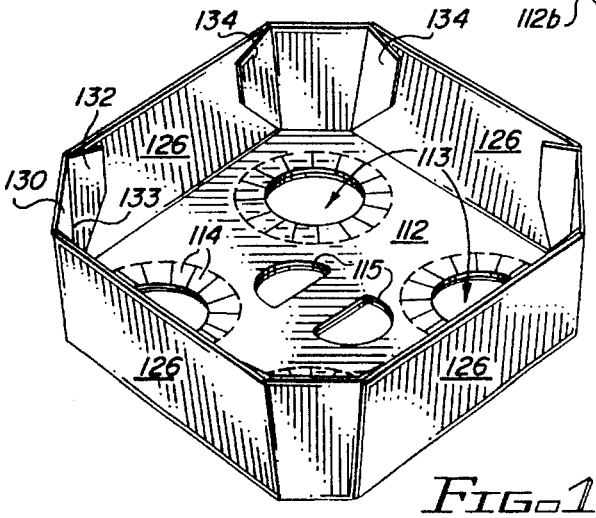

It will be understood that, for purposes of clarity, certain elements may have been omitted from certain views where they are believed to be illustrated to better advantage in other views.

DESCRIPTION OF THE PREFERRED EMBODIMENT

Referring now to the drawings for a better understanding of the invention, it will be seen that in FIG. 1 there is illustrated a package P comprising a group of bottles B, with tapered upper portions and end closures or caps K, held together in a composite carrier indicated generally at C.

As best seen in FIGS. 4 and 6, Carrier C is a composite, two-piece structure comprising an outer member, indicated generally at 20, and an inner member, indicated generally at 10.

The outer member 20 is preferably formed from a die cut sheet of material, such as paperboard; while the inner member 10 may be from a die cut sheet of either paperboard or plastic material.

As best seen in FIG. 3, inner member 10 consists of a relatively thin, flat, preferably octagonal, panel 12 having opposed side edges **12*a* and opposed corner edges 12*b***.

Extending through panel 12 are a plurality of article receiving openings 13 adapted to receive upper portions of the packaged articles. Each opening 13 has a circular center portion **13*a* and a plurality of extensions 13*b*** projecting radially outward therefrom, whereby the overall shape of the opening is somewhat similar to the upper portion of a Celtic cross.

The sides of the extensions **13*b* form, with each other and with the outer periphery of the center portion 13*a*, a plurality of retaining tabs 15 adapted to extend upwardly through related article receiving openings 23 in the outer member 20** to engage the undersides of the end closures or caps K of the packaged bottles B in a manner described later herein.

Panel 12 may also be provided with a pair of, preferably semicircular finger holes 15 to facilitate lifting and carrying the package.

As best seen in FIG. 2, outer member 20 comprises a preferably octagonal top wall panel 22 having side and corner panels 26 and 28 foldably joined to side and corner edges thereof along fold lines 27 and 29, respectively.

Each corner panel 28 may be joined to end edges of adjacent side panels 26 by a pair of triangular gussets 30, each of which is connected to the corner panel 28 along a fold line 13 and to the side panel 26 along a fold line 33.

Top wall panel 22 is also provided with a plurality of circular article receiving openings 23 and a pair of semicircular finger holes 25, which are aligned with the related article receiving openings 13 and finger holes 15, respectively, of inner member 10. It should be noted that the article receiving openings 23 of the outer member 20 are circular and are substantially larger that the article receiving openings 13 of the inner member 10.

When the carrier is produced, the inner member panel 12 is placed over the inside surface of the outer member top wall panel 22, which has the same configuration as panel 12, and is then secured thereto by adhesive 33, as shown in FIG. 4.

At this time the upper member side and corner panels 26 and 28 are folded toward the inner member 10, and the gussets are adhesively secured to the related side panels 26 to form the complete carrier C, illustrated in FIGS. 1, 6, and 7.

It will be seen that the side and corner panels 26 and 28, respectively, do not extend at right angles to the main panel 22, but extend at an angle greater than 90 degrees, so that like carriers can be nested within each other for shipment and storage.

In order for the packer to package the articles, after a group of articles has been assembled the erected carrier is forced downwardly over the group of articles until upper portions of the articles extend through the aligned article receiving openings of both the inner and outer members, and the retaining tabs 14 of the inner member extend upwardly through the larger article receiving openings of the outer member and engage the undersides of the article end closures to retain the articles in the carrier.

Although the carrier has been described and illustrated herein as a carrier for bottles, it should be understood that, by making slight modifications in the sizes of the outer and inner member panels and the location of the openings the carrier is equally suitable for holding a group of the new style beverage cans that have side walls recessed below the end closures.

What is claimed is:

1. An article package including a plurality of bottles each, including a body, with a necked upper portion presenting a generally cylindrical vertical surface, and an end closure projecting radially outward a slight distance beyond said body vertical surface, and a composite carrier, said carrier comprising:

(a) an outer member formed from a relatively thin, flat, blank of sheet material and including a horizontal top wall panel having side wall panels foldably joined to side edges thereof and extending downwardly therefrom over upper portions of said bottles;

(b) said outer member top wall panel including:

(i) a plurality of circular bottle receiving openings spaced from each other and each having a diameter greater than the diameter of an upper portion of each of said bottles;

(ii) at least one finger opening;

(c) an inner member including a relatively thin, flat, panel formed from a blank of sheet material, and including:

(i) at least one finger opening aligned with a said outer member finger opening;

(ii) a plurality of bottle receiving openings spaced from each other, each opening including a generally circular center portion, having a diameter less than the diameter of a related one of said outer member bottle receiving openings, and a plurality of generally rectangular projections extending radially outward from said center portion;

(iii) said projections defining, with said center portion and with each other, a plurality of article retaining tabs adapted to extend upwardly through related bottle receiving openings in said outer member for engagement with a related one of said bottle end closures.

2. A composite article carrier for holding a plurality of articles, such as beverage cans or bottles, each including a body member, with a recessed upper portion presenting a generally cylindrical vertical surface, and an end closure member projecting radially outward a slight distance beyond said body member vertical surface, said carrier comprising:

(a) an outer member formed from a relatively thin, flat, blank of sheet material and including a horizontal top wall panel having side wall panels foldably joined to side edges thereof and extending downwardly therefrom over upper portions of said bottles;

(b) said outer member top wall panel including:

(i) a plurality of circular bottle receiving openings spaced from each other and each having a diameter greater than the diameter of an upper portion of each of said articles;

(ii) at least one finger opening;

(c) an inner member including a relatively thin, flat, panel formed from a blank of sheet material, and including:

(i) at least one finger opening aligned with a said outer member finger opening;

(ii) a plurality of article receiving openings spaced from each other, each opening including a generally circular center portion, having a diameter less than the diameter of a related one of said outer member article receiving openings, and a plurality of generally rectangular projections extending radially outward from said center portion;

(iii) said projections defining, with said center portion and with each other, a plurality of article retaining tabs adapted to extend upwardly through related article receiving openings in said outer member for engagement with a related one of said article end closure members.

3. A composite article carrier for holding a plurality of articles, such as beverage cans or bottles, each including a body member, with a recessed upper portion presenting a generally cylindrical vertical surface, and an end closure member projecting radially outward a slight distance beyond said body member vertical surface, said carrier comprising:

(a) an outer member formed from a relatively thin, flat, blank of sheet material and including a horizontal top wall panel;

(b) said outer member top wall panel including:

(i) a plurality of circular bottle receiving openings spaced from each other and each having a diameter greater than the diameter of an upper portion of each of said articles;

(ii) at least one finger opening;

(c) an inner member including a relatively thin, flat, panel formed from a blank of sheet material, and including:

(i) at least one finger opening aligned with a said outer member finger opening;

(ii) a plurality of article receiving openings spaced from each other, each opening including a generally circular center portion, having a diameter less than the diameter of a related one of said outer member article receiving openings, and a plurality of generally rectangular projections extending radially outward from said center portion;

(iii) said projections defining, with said center portion and with each other, a plurality of article retaining tabs adapted to extend upwardly through related article receiving openings in said outer member for engagement with a related one of said article end closure members.

4. A package according to claim 1, wherein said carrier outer and inner members are each formed from a die cut sheet of paperboard.

5. A carrier according to claim 2, wherein said carrier outer and inner members are each formed from a die cut sheet of paperboard.

6. A carrier according to claim 3, wherein said carrier outer and inner members are each formed from a die cut sheet of die cut paperboard.

7. A package according to claim 1, wherein said carrier outer member is formed from a die cut sheet of paperboard, and wherein said carrier inner member is formed from a die cut sheet of plastic material.

8. A carrier according to claim 2, wherein said outer member is formed from a die cut sheet of paperboard, and wherein said inner member is formed from a die cut sheet of plastic material.

9. A carrier according to claim 3, wherein said outer member is formed from a die cut sheet of paperboard, and wherein said inner member is formed from a die cut sheet of plastic material.

10. A package according to claim 1, wherein said carrier outer member top wall panel and inner member panel are substantially congruent and are adhesively secured to each other.

11. A carrier according to claim 2, wherein said outer member top wall panel and inner member panel are substantially congruent and are adhesively secured to each other.

12. A carrier according to claim 3, wherein said outer member top wall panel and inner member panel are substantially congruent and are adhesively secured to each other.

13. A carrier according to claim 3, wherein said outer member includes side panels foldably joined to side edges of said top wall panel and extending downwardly therefrom over upper portions of said articles;

14. A package according to claim 1, wherein said outer member side panels slope outwardly from said top wall panel to permit nesting of similar size empty carriers with each other.

15. A carrier according to claim 2, wherein said outer member side panels slope outwardly from said top wall panel to permit nesting of similar size empty carriers with each other.

16. A carrier according to claim 13, wherein said outer member side panels slope outwardly from said top wall panel to permit nesting of similar size empty carriers with each other.

17. A package according to claim 1, wherein said outer member top wall panel is octagonal and includes corner panels foldably joined to corner edges and extending downwardly therefrom between adjacent ones of said side panels, and being joined thereto.

18. A carrier according to claim 2, wherein said outer member top wall panel is octagonal and includes corner panels foldably joined to corner edges and extending downwardly therefrom between adjacent ones of said side panels, and being joined thereto.

19. A carrier according to claim 13, wherein said outer member top wall panel is octagonal and includes corner panels foldably joined to corner edges and extending downwardly therefrom between adjacent ones of said side panels, and being joined thereto.

20. A carrier according to claim 19, wherein each of said outer member corner panels are joined to adjacent ones of said side panels by triangular gusset elements.

* * * * *